US007047576B2

(12) United States Patent
Tavivian

(10) Patent No.: US 7,047,576 B2
(45) Date of Patent: May 23, 2006

(54) PLASTIC PROFILE

(75) Inventor: Aharon Tavivian, Omer (IL)

(73) Assignee: MTD Industries, Ltd., Beer Sheva (IL)

( * ) Notice: Subject to any disclaimer, the term of this patent is extended or adjusted under 35 U.S.C. 154(b) by 0 days.

(21) Appl. No.: 10/814,787

(22) Filed: Apr. 1, 2004

(65) Prior Publication Data

US 2004/0221384 A1 Nov. 11, 2004

Related U.S. Application Data

(63) Continuation-in-part of application No. 10/280,126, filed on Oct. 25, 2002, now abandoned.

(51) Int. Cl.
*A47K 3/22* (2006.01)

(52) U.S. Cl. ..... 4/596; 4/600; 4/610; 4/614; 16/225; 16/DIG. 13

(58) Field of Classification Search ..... 4/596, 4/599, 600, 607, 609, 610, 612, 614; 52/282.1, 52/456, 584.1, 631, 716.8, 780; 16/225, 16/DIG. 13; 24/336; 160/135, 199, 206, 160/225, 235
See application file for complete search history.

(56) References Cited

U.S. PATENT DOCUMENTS 3,460,860 A * 8/1969 Stevens, Jr. ..... 52/584.1
4,296,524 A * 10/1981 Horholt et al. ..... 16/225
4,563,381 A * 1/1986 Woodland ..... 428/156
4,828,132 A * 5/1989 Francis et al. ..... 220/6
5,450,694 A 9/1995 Goranson et al.
5,487,690 A * 1/1996 Stoffle et al. ..... 446/105
5,729,867 A * 3/1998 Carmichael ..... 16/225

FOREIGN PATENT DOCUMENTS

WO WO 01 17411 3/2001

* cited by examiner

*Primary Examiner*—Justine R. Yu
*Assistant Examiner*—Huyen Le
(74) *Attorney, Agent, or Firm*—Banner & Witcoff, Ltd.

(57) ABSTRACT

The invention provides a variable angle connector profile for connecting a plurality of enclosure panels, the profile comprising: a first end segment having a first open channel sized for receiving a first enclosure panel; a flexible middle segment attached to the first end segment; and a second end segment attached to the middle segment and having a second open channel sized for receiving a second enclosure panel; the middle segment including a flexible plastic material and the end segments including at least a semi-rigid material, all three segments being co-extruded as a single integral linear unit and wherein each of the first and second end segments includes surfaces adapted to abut each other and to delimit the extent of movement of the end segments towards each other in a first sense of swivel from a linear alignment of 180° to a substantially perpendicular alignment of about 90°, while the segments are free to move in a second sense of swivel away from the surfaces to form a reflex angle therebetween, for accordian-like folding, storage and transport of a plurality of panels interconnected therewith.

9 Claims, 2 Drawing Sheets

Fig. 5
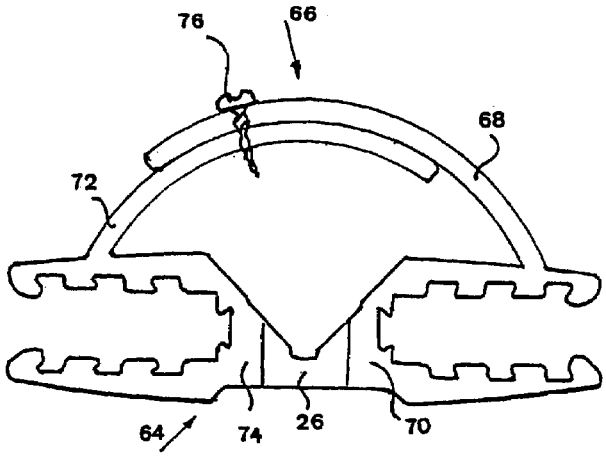
Fig. 6
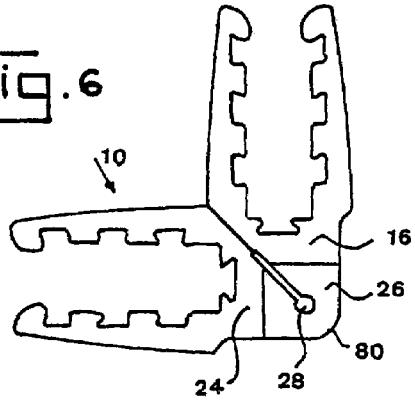
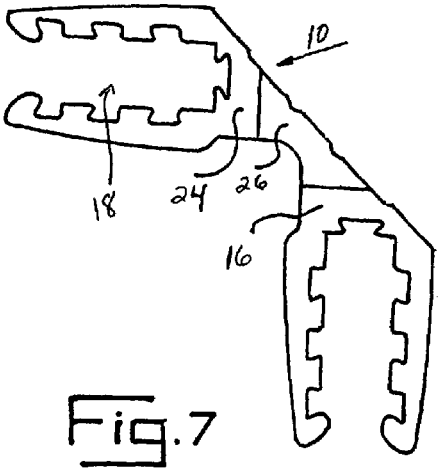
Fig. 7
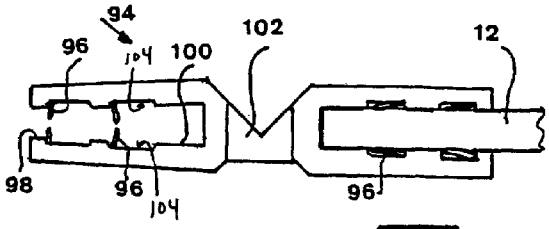
Fig. 9
Fig. 8
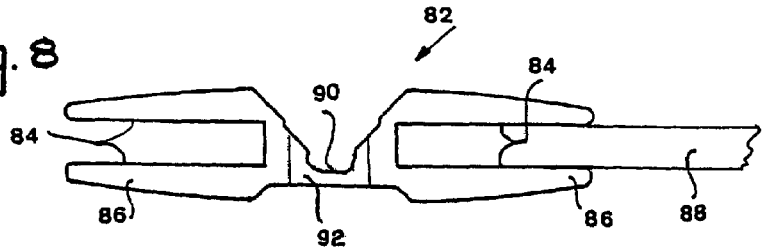

PLASTIC PROFILE

CROSS-REFERENCE TO RELATED APPLICATIONS

This application is a Continuation-In-Part of U.S. Ser. No. 10/280,126 filed Oct. 25, 2002, now abandoned, which application is incorporated herein by reference in its entirety.

BACKGROUND OF THE INVENTION

The present invention relates to a plastic profile which is angularly adjustable. More particularly, the invention provides a plastic profile which can either be set to a desired angle, or can be used as a door or window hinge. The profile is of particular utility in the construction of a shower stall.

In our Israel Specification No. 117,154 there is described a prefabricated vertical shower stall made of several panels, corner connecting profiles and other components. Shower stalls of this type are often square or rectangular in plan view. However, it is sometimes advantageous to allow some of the corners to form an angle that is other than 90 degrees. Such a requirement may arise when the enclosure is to be erected in a non-rectangular space, or when a user is interested in such a shape for purposes of style. Few prior-art shower stalls allow such an installation; one that does so requires three profiles for this purpose, allowing corner angles to be adjusted only in coarse increments of about 30 degrees. The above-mentioned Israel Specification describes and claims a shower stall which includes, in one of its embodiments a multi-functional profile enabling alternative rigid linear and variable angle connections, said profile having an open channel bracketed by at least two opposite outer sectors forming part of a circle, each of said sectors having a plurality of spaced-apart external ridges. The spaces between these ridges which control the angle setting are typically up to 20 or 25 degrees. Such a joint is made of two separate rigid extrusions, the angle being set on assembly on site by drilling and inserting screws through the mating profiles.

Although the above-described profile joint has been used in commercially successful designs, the following problems remained:

a) For space reasons, the panels could not be preassembled as shower enclosures in the factory, stored and transported to the user as one unit.

b) Although panel assembly at different angles was possible, such angles were still limited to increments of about 20°, according to the ridges on the outer face of the multi-functional profile.

It is therefore one of the objects of the present invention to obviate the disadvantages of the prior-art connector profiles and to provide a profile which, as a single unit, allows changes in the angle between its panel holders to be readily made which in prior-art designs requires two profiles. It is a further object of the present invention to provide a connector profile being absolutely leak-proof without requiring the use of a sealing element. Yet a further object of the present invention is to allow large-angle changes, such as those which are needed when a shower enclosure is folded flat for purposes of storage or transport.

SUMMARY OF THE INVENTION

The present invention achieves the above objectives by providing a variable angle connector profile for connecting a plurality of enclosure panels, said profile comprising a first end segment having a first open channel sized for receiving a first enclosure panel;

a flexible middle segment attached to said first end segment; and a second segment attached to said middle segment and having a second open channel sized for receiving a second enclosure panel;

said middle segment including a flexible plastic material and said end segments including at least a semi-rigid material, all three segments being co-extruded as a single integral linear unit and wherein each of said first and second end segments includes surfaces adapted to abut each other and to delimit the extent of movement of said end segments towards each other in a first sense of swivel from a linear alignment of 180° to a substantially perpendicular alignment of about 90°, while said segments are free to move in a second sense of swivel away from said surfaces to form a reflex angle therebetween, for accordian-like folding, storage and transport of a plurality of panels interconnected therewith.

In a preferred embodiment of the present invention, there is provided a variable angle connector profile unit wherein the middle segment is made of flexible polyvinyl chloride (PVC) and the end segments are made of at least semi-rigid PVC.

In a most preferred embodiment of the present invention, there is provided a variable angle connector profile unit wherein the middle segment has an operating life in excess of 10,000 bend cycles and said profile unit forms a part of a door assembly, including its hinge.

Yet further embodiments of the invention will be described hereinafter.

It will be realized that the novel profile of the present invention serves in a new application which was not possible with previous designs. Since it was found that such a variable angle connector profile could be manufactured to have an operating life exceeding 10,000 bend cycles, it became possible to use the profile as a hinge for a door or window. An important advantage of this type of hinge is that, due to continuity of material, there is no leakage path at any angle of use, and so no seal elements are required. Obviously, such inherent sealing is a significant advantage in the construction of a shower stall.

The technique of coextrusion has been known for well over a decade, although the usual application of this method is for the production of film or sheet. In film manufacture, it is not unusual for four extruders to form five layers which are combined before leaving the die. Different materials are melted in separate chambers and simultaneously extruded and combined while still hot, in one of two ways: either a single manifold die is used, and the extrusions are combined in a combining adaptor, or a multi-manifold die is used, the extrusions combining at the exit of the die.

The three segments forming the connector profile unit of the present invention could be extruded separately and joined, when cold, by an suitable fabrication technique. However, the use of coextrusion produces a superior joint at lower cost and is inherently completely leakproof.

In our WO 01/17411, the relevant teachings of which are incorporated hereby be reference, there is described and claimed a shower enclosure comprising:

a) at least two adjoining panels, at least one of which is at least indirectly attachable to a wall; and b) at least one flexible, hinged, load-bearing, integrally-formed connector that dynamically connects said panels, said connector including a first end segment, a flexible middle segment, and a second end segment, said end segments being moveable between a first substantially planir position and a second position, wherein the planes of said end segments are substantially perpendicular to each other; said middle segment including a flexible plastic material and said end segments including at least a semi-rigid material, all three segments being co-extruded as a single integral linear unit and wherein each of said first and second end segments include surfaces adapted to abut each other and to delimit the extent of movement of said end segments towards each other from a linear alignment of 180° to a substantially perpendicular alignment of about 90°.

As will be realized in our WO specification there is neither taught nor suggested the improved connector of the present invention characterized in that all three segments are co-extruded as a single integral linear unit and wherein each of said first and second end segments includes surfaces adapted to abut each other and to delimit the extent of movement of said end segments towards each other in a first sense of swivel from a linear alignment of 180° to a substantially perpendicular alignment of about 90°, while said segments are free to move in a second sense of swivel away from said surfaces to form a reflex angle therebetween, for accordian-like folding, storage and transport of a plurality of panels interconnected therewith.

In German specification 2901371 and in French patent application 81 06977, published under no. 2503230, there are described flexible hinged connectors, however said connectors are not provided with means to enable movement between a first planir position of about 180° and a second position of about 90° and certainly do not teach nor suggest the partitions of the present invention characterized in that all three segments are co-extruded as a single integral linear unit and wherein each of said first and second end segments includes surfaces adapted to abut each other and to delimit the extent of movement of said end segments towards each other in a first sense of swivel from a linear alignment of 180° to a substantially perpendicular alignment of about 90°, while said segments are free to move in a second sense of swivel away from said surfaces to form a reflex angle therebetween, for accordian-like folding, storage and transport of a plurality of panels interconnected therewith, and therefore do not provide an acceptable solution for the interconnection of panels as taught for the first time in the present invention.

Similarly, while U.S. Pat. No. 5,729,867 discloses a flexible, hinged, load-bearing, integrally formed connector, including a first end segment, a flexible middle segment and a second end segment in which the middle segment includes a flexible plastic material and all three segments are co-formed as a single integral unit, and while U.S. Pat. No. 5,115,855 discloses a flat panel display end hinge in which the hinge means is three segments which are co-extruded as a single linear unit, neither of said references teaches or suggests a flexible hinged, load-bearing, integrally formed connector, comprising first and second end segments which include integral abutment and/or stop means adapted to limit the extent of rotation of said end segments towards each other from a linear alignment of about 180° to a substantially perpendicular alignment of about 90°.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

BRIEF DESCRIPTION OF THE DRAWINGS

FIG. 5 is an end view of a variable angle connector profile of the invention, further comprising retention means;

FIG. 6 is an end view of the embodiment shown in FIG. 1, bent inward at an angle of 90 degrees;

FIG. 7 is an end view of the embodiment shown in FIG. 1, bent outward at an angle of 90 degrees, FIG. 8 is an end view of a further embodiment of the connector profile unit of the present invention, wherein the inner faces of the open channels are smooth; and FIG. 9 is an end view of a further embodiment of the connector profile unit of the present invention, wherein the inner faces of the open channels include retaining members.

DETAILED DESCRIPTION OF THE PREFERRED EMBODIMENTS

Figure 1:
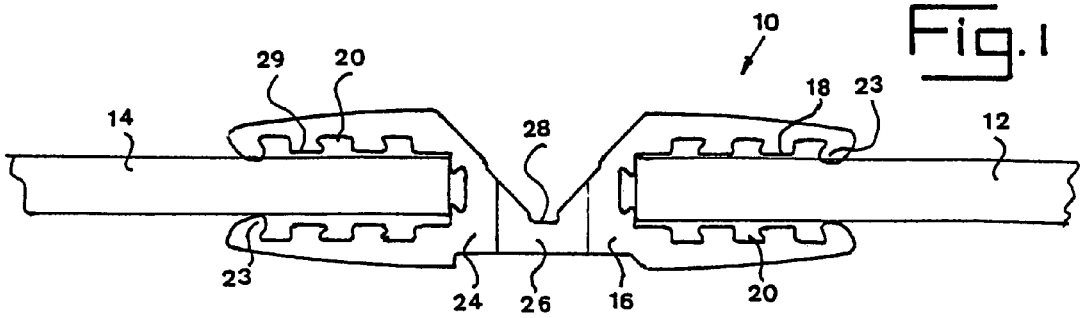
FIG. 1 is an enlarged end view of a preferred embodiment of a connector profile according to the invention.

There is seen in FIG. 1 a variable angle connector profile unit 10 for connecting two enclosure panels 12, 14. A first end segment 16 has a first open channel 18, sized for receiving therein a first enclosure panel 12. In the present embodiment, the first open channel 18 is sized to receive an unframed panel such as, for example, a sheet of safety glass. The side recesses 20 can be utilized for a liquid-in-use sealant, while the end recess 22 can be used to retain a flexible seal strip (not shown). The channel 18 could, of course, be made wider for accepting a framed panel. The end segments 16, 24 are made of at least a semi-rigid plastic material. A suitable plastic is rigid or semi-rigid polyvinyl chloride (PVC).

A flexible middle segment 26 is attached to the first end segment 16. The middle segment 26 is shaped to allow it to bend inward up to 90 degrees, as will be seen in FIG. 6, and similarly, to bend outward, as will be seen in FIG. 7. Middle segment 26 is made of a plastic material such as flexible PVC. In a preferred embodiment, the soft, flexible PVC material can be formed of "APEX 586" available from TEKNOR APEX of Pawtucket, R.I. This flexible compound has a hardness of about 85 (Shore A Durometer (+/−3)) and a tensile strength of about 2750 lbs/sq. in. The soft flexible PVC material has an elongation of about 350% and a brittle point of about −29° C.

The center recess 28 is shaped to facilitate said bending and to avoid sharp section changes in order to eliminate stress concentrations during bending, as will be seen in FIG. 6. Middle segment 26 has a thickness of between about 0.6 mm and 1.5 mm. The width of the middle segment extends in the direction between end segments 16, 24. The middle segment 26 has a length of at least 1 meter in a direction perpendicular to the width, such as in a vertical direction.

A second end segment 24 is attached to middle segment 26. The second open channel 29 shown is similar to the first open channel 18, and is sized to receive a second enclosure panel 14. If so required, the open channels 18, 29 can have different dimensions and configurations.

The three segments 16, 24, 26 are attached to each other by being co-extruded as a single integral unit. Covalent bonds are formed when the hot extrusions meet, resulting in adhesion lines which are as strong as the parent plastic. It goes without saying that such a bond is completely water-tight; of more significance is the high fatigue limit of the joint, which can be bent many times without danger of delamination.

With reference to the rest of the Figures, similar reference numerals have been used to identify similar parts.

Figure 2:
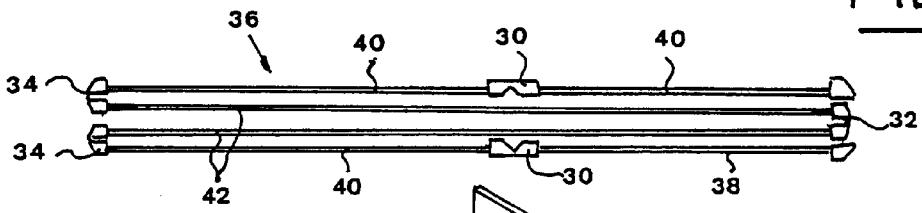
FIG. 2 is a plan view, on a small scale, of a folded shower stall using the connector profile units of the present invention.

Referring now to FIG. 2, several variable angle connector profile units 30, 32, 34 are shown as used in a low-cost shower stall assembly 36, which is illustrated in folded condition for storage and transport. The panel 38 forms the entrance door of the shower stall. Use of the variable angle connector unit 30 will be described below with reference to FIG. 4. The connector profile 32 is designed to allow a bend of 270 degrees between erection and folding of the shower stall. Folding of the shower stall assembly 36 brings substantial savings to transport and storage operations, and by avoiding disassembly of the panels 38, 40, 42, on-site erection time is saved. In addition, the householder who may install the shower stall is not necessarily expert at assembly of such items, and receiving an enclosure in its pre-assembled configuration is of value in avoiding assembly errors and service calls.

Figure 3:
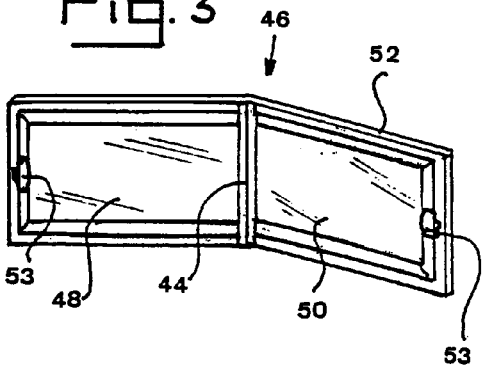
FIG. 3 is a perspective view of a multi-window assembly using the connector profile units of the invention.

FIG. 3 illustrates a variable angle connector profile unit 44 used in a multi-window assembly 46. The windows 48 and 50 are held on angled intersecting planes in a rigid frame 52. The vertical connector profile unit 44 takes up the required angle, acts as a hinge and connects the windows 48, 50 in a leak-proof manner. The same profile 44 is also used horizontally. The windows 48, 50 are openable using latches 53, due to the flexibility of connector profile unit 44.

Figure 4:
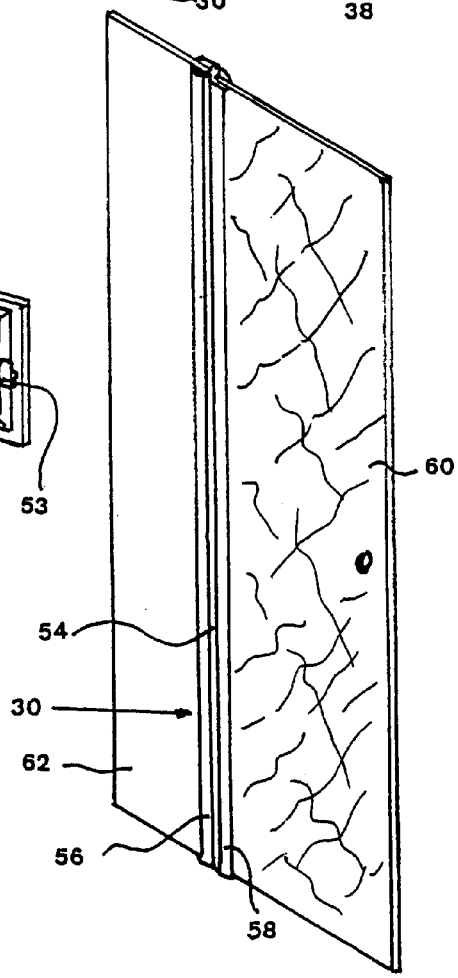
FIG. 4 is a perspective view of a door assembly using a connector profile unit of the invention as a hinge.

Seen in FIG. 4 is a variable angle connector profile unit 30, having substantially the same shape and size as unit 10 shown in FIG. 1. However, in this embodiment, the middle segment 54 has an operating life in excess of 10,000 bend cycles. Advantageously, the middle segment is made of flexible polypropylene, and end segments 56, 58 are made of at least semi-rigid polypropylene. This material has excellent resistance to bend cracking, and its low specific weight and high chemical resistance makes it suitable for use in a long-lasting profile, producable at low cost.

The profile unit 30 shown in FIG. 4 forms part of a door assembly 60, including its hinge. The diagram shows a textured safety glass door used as part of a shower stall 62.

Referring now to FIG. 5, there is depicted a variable angle connector profile unit 64, further comprising retention means 66 for releasably holding unit 64 at a desired angle. A first curved tongue 68 extends from the first end segment 70 and a second curved tongue 72 extends from the second end segment 74. The two tongues 68, 72 are mutually proximate, and a plurality of fasteners 76 are inserted to retain any desired profile unit angle within the unit's range.

FIG. 6 illustrates the embodiment 10 shown in FIG. 1, bent inward to its limit, which in this example is 90 degrees. It will be noted that the recess 28 now forms center hole 78. The outer corner 80 also forms part of a circle, thus reducing stress concentration and contributing to the long life of the profile unit.

FIG. 7 illustrates the profile 10 bent outward 90 degrees. It will be noted that even further bending is possible. Re-examining FIG. 2, it will be seen that the profile units 32 are bent 180 degrees, or very close to that angle. Such severe bending is, however, usually carried out only once or twice when the enclosure is folded, and so there is no material fatigue problem.

Seen in FIG. 8 is a further embodiment 82 of the profile unit shown in FIG. 1. However, in this embodiment, the inner faces 84 of the open channels 86 are smooth. The channels 86 are appropriate for use when the enclosure panel 88 to be inserted therein is to be attached by means of an adhesive instead of a sealant. The center 90 of the flexible middle segment 92 has a thin section to reduce bending stresses.

An additional embodiment 94 of the profile unit of FIG. 1 is illustrated in FIG. 9. In this embodiment of the profile unit 94, the inner faces 98 of the channels 100 include deflectable retaining members 96 that extend outwardly from respective recesses 104 toward the center of the channel 100. The retaining members 96 help to maintain the position of a panel 12 within a channel 100. As a panel 12 is inserted into the unit 94, these retaining members 96 engage the panel 12 and deflect into their respective recesses 104 as the panel 12 moves within the channel 100 (FIG. 9). The flexible middle segment 102 has an area of reduced thickness to permit bending.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A variable angle load-bearing connector profile for connecting a plurality of shower enclosure assembly panels, said profile comprising:

a first end segment having a first open channel sized for receiving a first flat-surfaced enclosure panel, said open channel being defined by an inner surface of each of a pair of substantially coextensive first end segment sidewalls;

a flexible middle segment attached to said first end segment; and a second end segment attached to said middle segment and having a second open channel sized for receiving a second flat-surfaced enclosure panel, said second open channel being defined by an inner surface of each of a pair of substantially coextensive second end segment sidewalls;

said middle segment including a flexible plastic material and said end segments including at least a semi-rigid material, all three segments being co-extruded as a single integral linear unit and wherein each of said first and second end segments includes surfaces adapted to abut each other and to delimit the extent of movement of said end segments towards each other in a first sense of swivel from a linear alignment of 180° to a substantially perpendicular alignment of about 90°, wherein said flexible middle segment allows said first and second segments to repeatedly move in the first sense of swivel from the linear alignment of 180° to the substantially perpendicular alignment of about 90° and to move in a second, opposite sense of swivel away from said 180° linear alignment and away from said surfaces to form a reflex angle therebetween for accordion-like folding, storage and transport of a plurality of panels interconnected therewith, wherein said middle segment has an operating life in excess of 10,000 bend cycles, a tensile strength of about 2750 lbs/sq. in., and an elongation of about 350%, and wherein at least one of said open channels includes a plurality of flexible projections extending into said at least one of said open channels from each of the inner surfaces of the sidewalls defining said at least one of said open channels for firmly gripping a flat-surfaced panel when positioned within said at least one of said open channels.

2. The variable angle connector profile according to claim 1, wherein said middle segment is made of flexible polyvinyl chloride (PVC) and said end segments are made of at least semi-rigid PVC.

3. A variable angle connector profile according to claim 1, wherein said middle segment is made of flexible polypropylene and said end segments are made of at least semi-rigid polypropylene.

4. A variable angle connector profile according to claim 1, further comprising retention means for releasably holding said profile at a desired angle.

5. A variable angle connector profile according to claim 1, wherein said middle segment has a thickness of between about 0.6 and 1.5 mm and a width of about 3 and 6 mm.

6. A variable angle connector profile according to claim 1, wherein said middle segment has a length of at least 1 meter.

7. A variable angle connector profile according to claim 1, in combination with a door panel of said shower enclosure assembly wherein said profile forms the binge of said door.

8. A variable angle connector profile according to claim 1, wherein said flexible middle segment has a brittle point of about −29° C.

9. A variable angle connector profile for connecting a plurality of enclosure assembly panels, said profile comprising:

a first end segment having a first open channel sized for receiving a first enclosure panel, said open channel being defined by an inner surface of each of a pair of first end segment sidewalls;

a flexible middle segment attached to said first end segment; and a second end segment attached to said middle segment and having a second open channel sized for receiving a second enclosure panel, said second open channel being defined by an inner surface of each of a pair of second end segment sidewalls;

said middle segment including a flexible plastic material and said end segments including at least a semi-rigid material, all three segments being co-extruded as a single integral linear unit and wherein each of said first and second end segments includes surfaces adapted to abut each other and to delimit the extent of movement of said end segments towards each other in a first sense of swivel from a linear alignment of 180° to a substantially perpendicular alignment of about 90° , while said segments are free to move in a second sense of swivel away from said surfaces to form a reflex angle therebetween, for accordion-like folding, storage and transport of a plurality of panels interconnected therewith; and retention means for releasably holding said profile at a desired angle.

* * * * *